US008348309B2

(12) United States Patent
Patel et al.

(10) Patent No.: US 8,348,309 B2
(45) Date of Patent: Jan. 8, 2013

(54) ENERGY ABSORBING BUMPER FOR LATCH CLOSING SOUND QUALITY

(75) Inventors: Rajesh K Patel, Farmington Hills, MI (US); Kosta Papanikolaou, Huntington Woods, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 129 days.

(21) Appl. No.: 12/951,673

(22) Filed: Nov. 22, 2010

(65) Prior Publication Data

US 2012/0126550 A1 May 24, 2012

(51) Int. Cl.
*E05C 3/06* (2006.01)
*E05B 15/02* (2006.01)

(52) U.S. Cl. ..... 292/195; 292/341.12; 292/DIG. 56; 292/DIG. 73

(58) Field of Classification Search ..... 292/195, 292/341.12, DIG. 56, DIG. 73
See application file for complete search history.

(56) References Cited

U.S. PATENT DOCUMENTS

| | | | | |
|---|---|---|---|---|
| 1,875,453 | A * | 9/1932 | Haskins | 16/86 B |
| 2,187,531 | A * | 1/1940 | Butler | 16/85 |
| 3,848,911 | A | 11/1974 | Watermann et al. | |
| 3,876,238 | A | 4/1975 | Watermann | |
| 4,073,519 | A * | 2/1978 | Kurozu et al. | 292/216 |
| 4,130,308 | A | 12/1978 | Jeavons | |
| 4,165,112 | A | 8/1979 | Kleefeldt | |
| 4,235,462 | A | 11/1980 | Torii et al. | |
| 4,429,068 | A | 1/1984 | Nakahira | |
| 4,569,544 | A * | 2/1986 | Escaravage | 292/216 |
| 4,679,836 | A | 7/1987 | Pupillo et al. | |
| 4,691,782 | A | 9/1987 | Stine | |
| 4,756,563 | A * | 7/1988 | Garwood et al. | 292/216 |
| 4,904,004 | A | 2/1990 | Bartczak | |
| 5,064,229 | A | 11/1991 | Hamada et al. | |
| 5,106,134 | A * | 4/1992 | Thau | 292/216 |
| 5,141,270 | A * | 8/1992 | Shibata | 292/216 |
| 5,727,825 | A * | 3/1998 | Spurr | 292/341.12 |
| 5,785,365 | A * | 7/1998 | Lorey | 292/216 |
| 5,918,918 | A | 7/1999 | Mosley | |
| 6,024,389 | A | 2/2000 | Arabia, Jr. et al. | |
| 7,264,283 | B2 | 9/2007 | Stoof et al. | |
| 7,401,822 | B2 | 7/2008 | Graute | |
| 7,503,598 | B2 * | 3/2009 | Graute | 292/216 |
| 7,780,205 | B2 * | 8/2010 | Graute | 292/216 |
| 7,845,692 | B2 * | 12/2010 | Inan et al. | 292/216 |
| 2008/0202176 | A1 | 8/2008 | Inan et al. | |
| 2008/0203737 | A1 | 8/2008 | Tomaszewski et al. | |
| 2009/0224559 | A1 * | 9/2009 | Park | 292/336.3 |
| 2011/0089706 | A1 * | 4/2011 | Bendel et al. | 292/341.12 |
| 2012/0126549 | A1 * | 5/2012 | Papanikolaou | 292/195 |

FOREIGN PATENT DOCUMENTS

EP 1065336 A1 * 1/2001

* cited by examiner

*Primary Examiner* — Carlos Lugo
(74) *Attorney, Agent, or Firm* — Jason Rogers; Price Heneveld LLP

(57) ABSTRACT

A vehicle door latch mechanism having a housing. A catch is rotatably connected with the housing and includes a striker retaining slot. A pawl is operably connected with the housing. A pawl isolation disk is disposed between the pawl and a frame plate. A striker is adapted for engagement with the catch. A striker bumper is adjacent the housing and includes an abutment surface and a striker damper surface.

20 Claims, 8 Drawing Sheets

ENERGY ABSORBING BUMPER FOR LATCH CLOSING SOUND QUALITY

FIELD OF THE INVENTION

The present invention generally relates to a vehicle door latch mechanism, and more particularly relates to an energy absorbing bumper for latch closing sound quality.

BACKGROUND OF THE PRESENT INVENTION

Often, consumers equate the performance and quality of vehicles and vehicle components with sound quality and minimal noise, vibration, and harshness (NVH) characteristics of vehicle components including the latching mechanism of a vehicle door. Providing a vehicle door that opens and closes properly and performs each of those functions with minimal audible indication can suggest to a consumer that the overall door assembly, the door closing mechanism, and the vehicle are of high quality.

SUMMARY OF THE PRESENT INVENTION

Accordingly, in a first disclosed embodiment, a vehicle door latch mechanism having a housing. A catch is rotatably connected with the housing and includes a striker retaining slot. A pawl is operably connected with the housing. A pawl isolation disk is disposed between the pawl and the frame plate. A striker is adapted for engagement with the catch. A striker bumper is adjacent the housing and includes an abutment surface and a striker damper surface.

In another disclosed embodiment, a vehicle door striker bumper includes a body portion having at least partially of a polynorbornene material. The vehicle door striker bumper includes a striker damper surface. An abutment surface is substantially orthogonal to the striker damper surface. A damper tab is positioned above the abutment surface.

In another disclosed embodiment, a method for making a door latch including forming a housing. A catch with a striker retainer slot is rotatably connected to the housing. A pawl is operably connected between the housing and a frame plate. A pawl isolation disk is positioned between the pawl and the frame plate. A striker bumper having a damper surface is positioned adjacent the housing. An abutment surface is formed on the striker bumper.

These and other aspects, objects, and features of the present invention will be understood and appreciated by those skilled in the art upon studying the following specification, claims, and appended drawings.

DETAILED DESCRIPTION OF EMBODIMENTS

Figure 1:
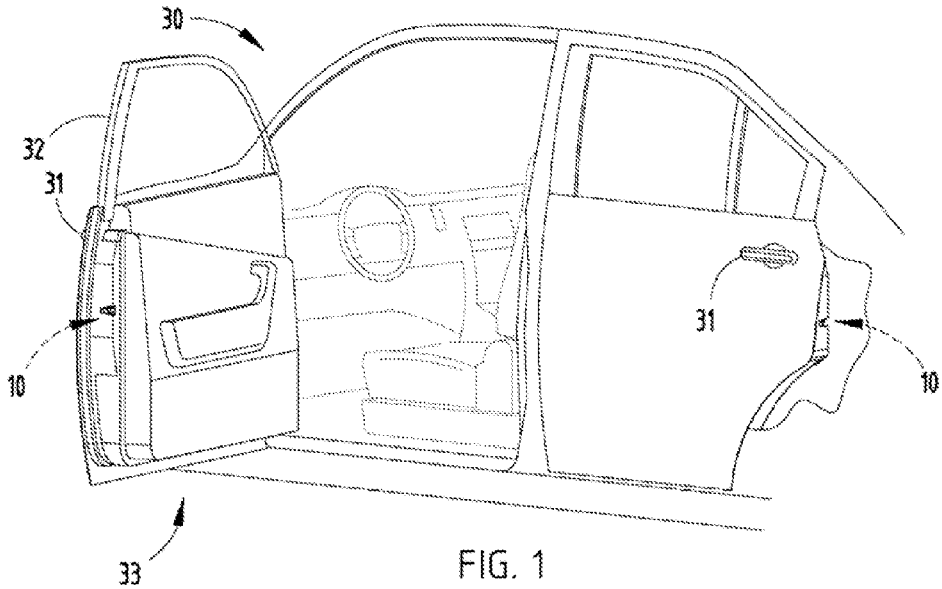
FIG. 1 is a top perspective view of a vehicle with a vehicle door incorporating one embodiment of the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
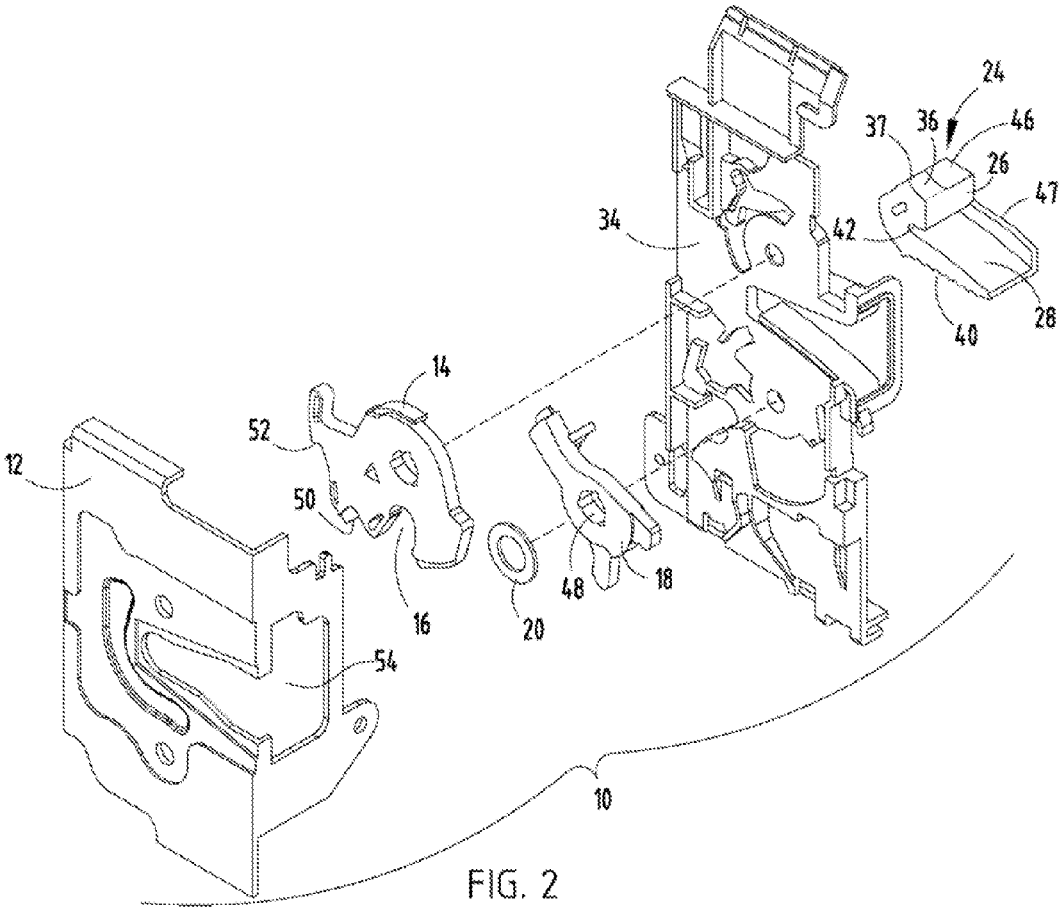
FIG. 2 is a top perspective exploded view of a vehicle door latch mechanism of the present invention.
Figure 3:
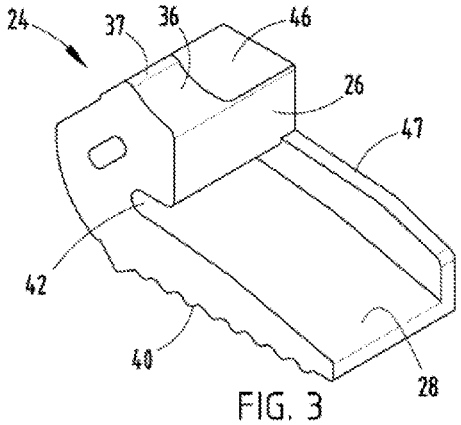
FIG. 3 is a top perspective view of one embodiment of a striker bumper of the present invention.
Figure 4:
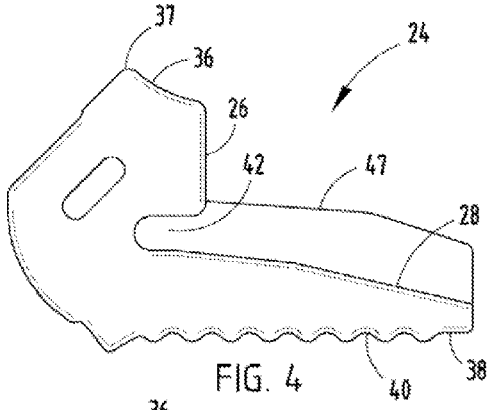
FIG. 4 is a first side elevational view of the striker bumper of FIG. 3.
Figure 5:
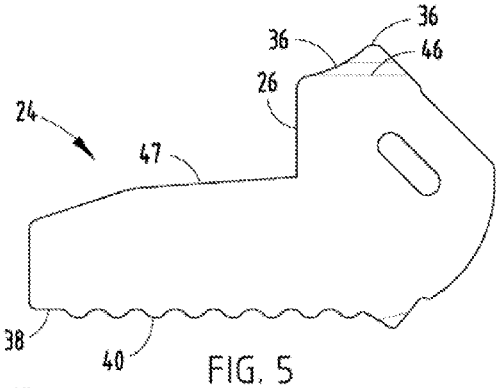
FIG. 5 is a second side elevational view of the striker bumper of FIG. 3.
Figure 6:
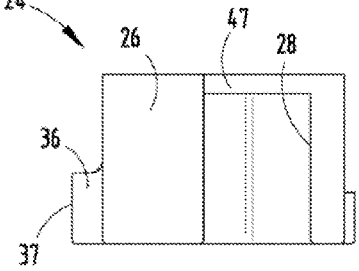
FIG. 6 is a front elevational view of the striker bumper of FIG. 3.
Figure 7:
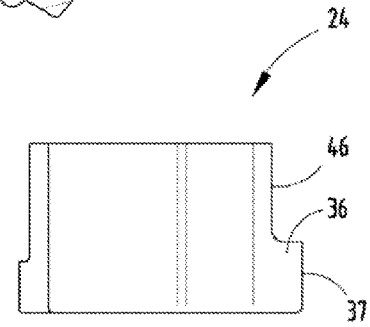
FIG. 7 is a rear elevational view of the striker bumper of FIG. 3.
Figure 8:
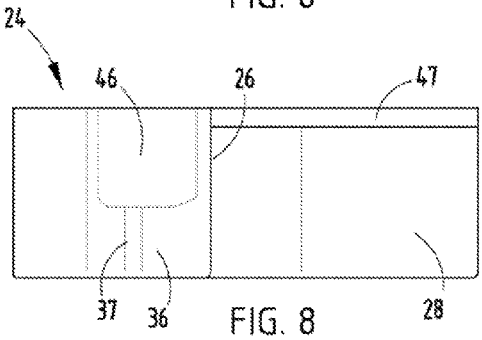
FIG. 8 is a top plan view of the striker bumper of FIG. 3.
Figure 9:
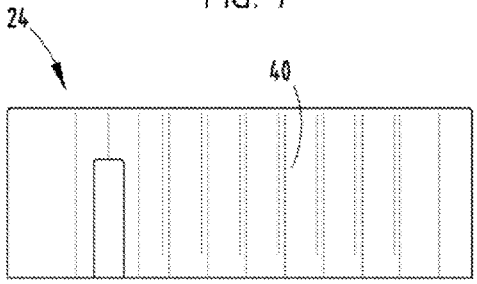
FIG. 9 is a bottom plan view of the striker bumper of FIG. 3.
Figure 17:
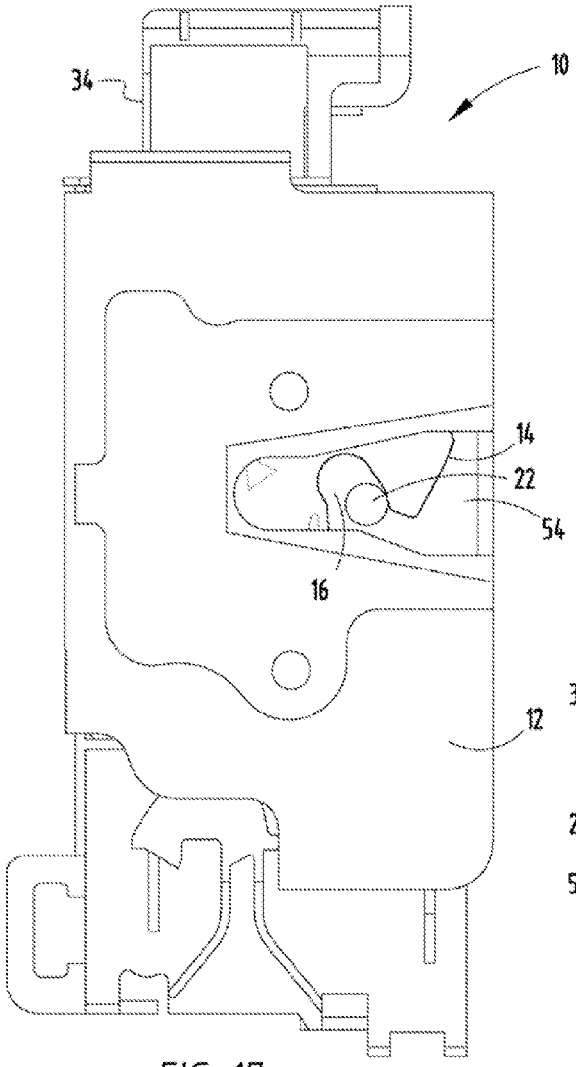
FIG. 17 is a side elevational view of the vehicle door latch mechanism in a semi-closed position.
Figure 18:
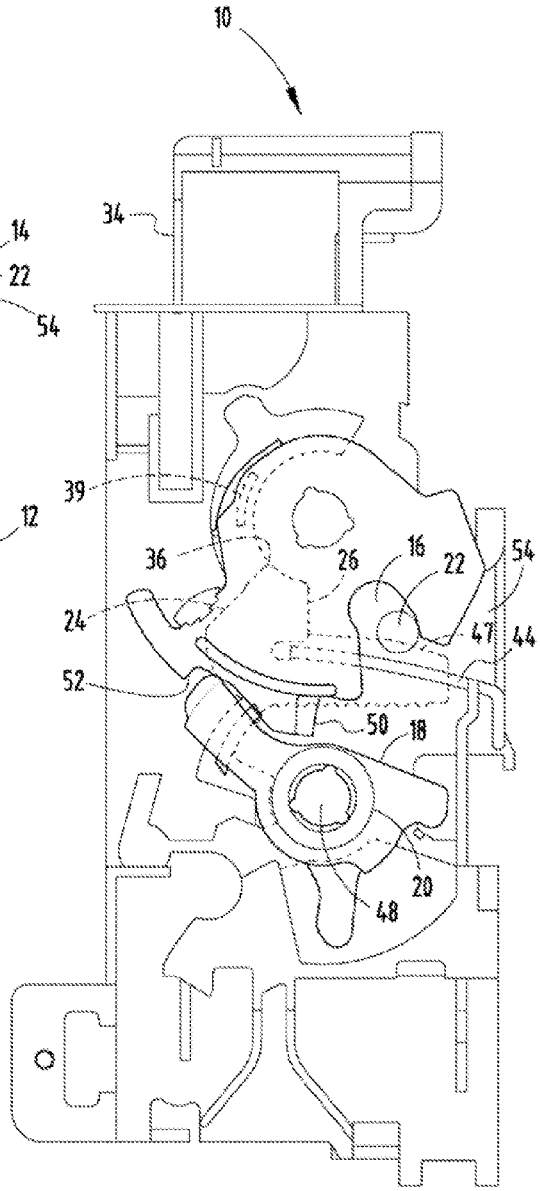
FIG. 18 is a side elevational view of the vehicle door latch mechanism in a semi-closed position with the frame plate removed.
Figure 19:
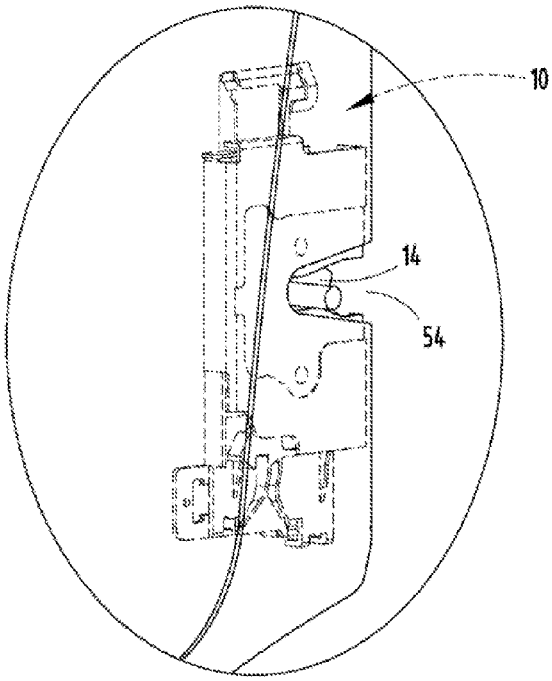
FIG. 19 is an enlarged top perspective view of the vehicle door latch mechanism in the closed position.
Figure 20:
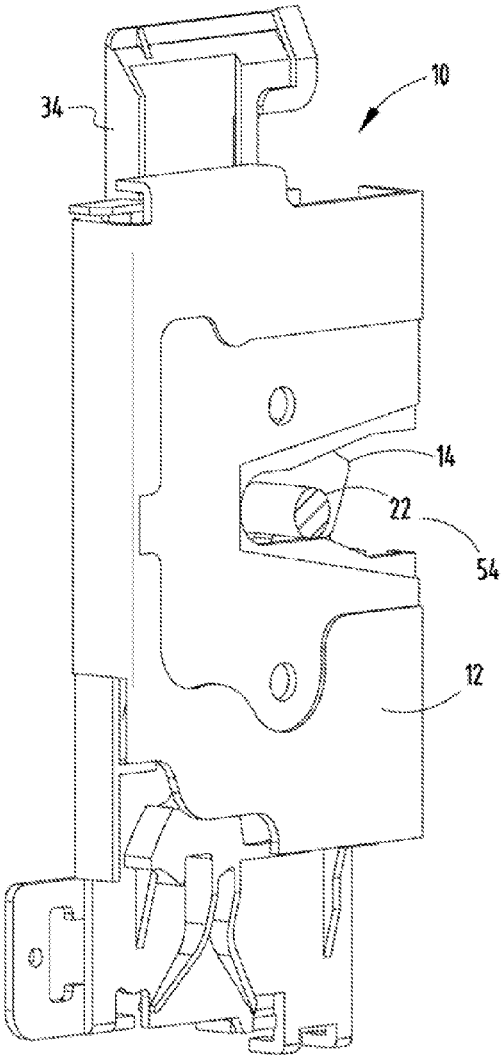
FIG. 20 is a top perspective view of the vehicle door latch mechanism in the closed position.
Figure 21:
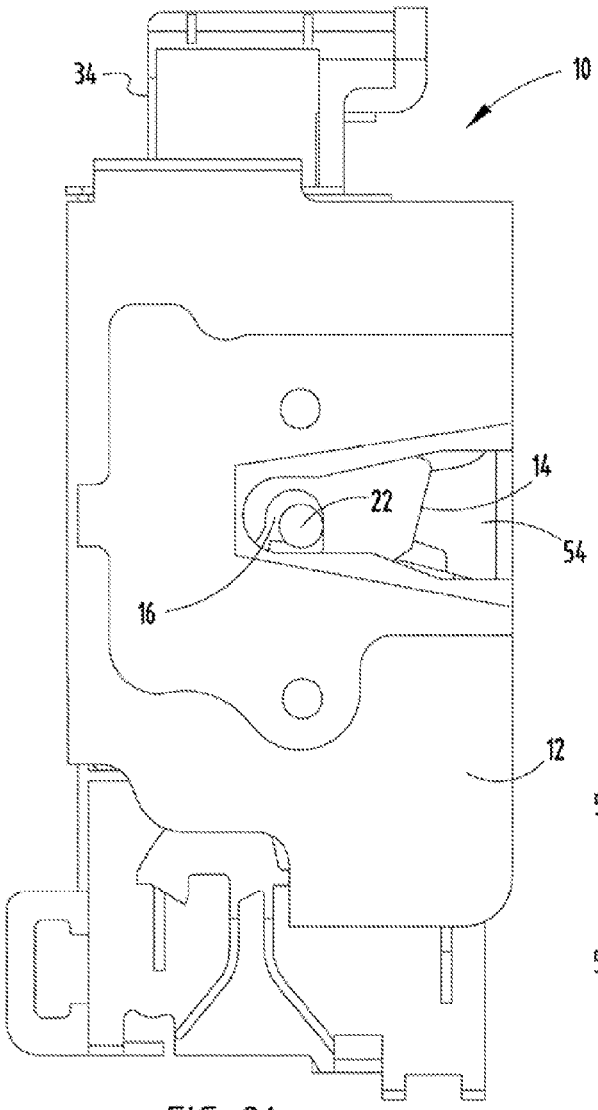
FIG. 21 is a side elevational view of the vehicle door latch mechanism in a closed position.
Figure 22:
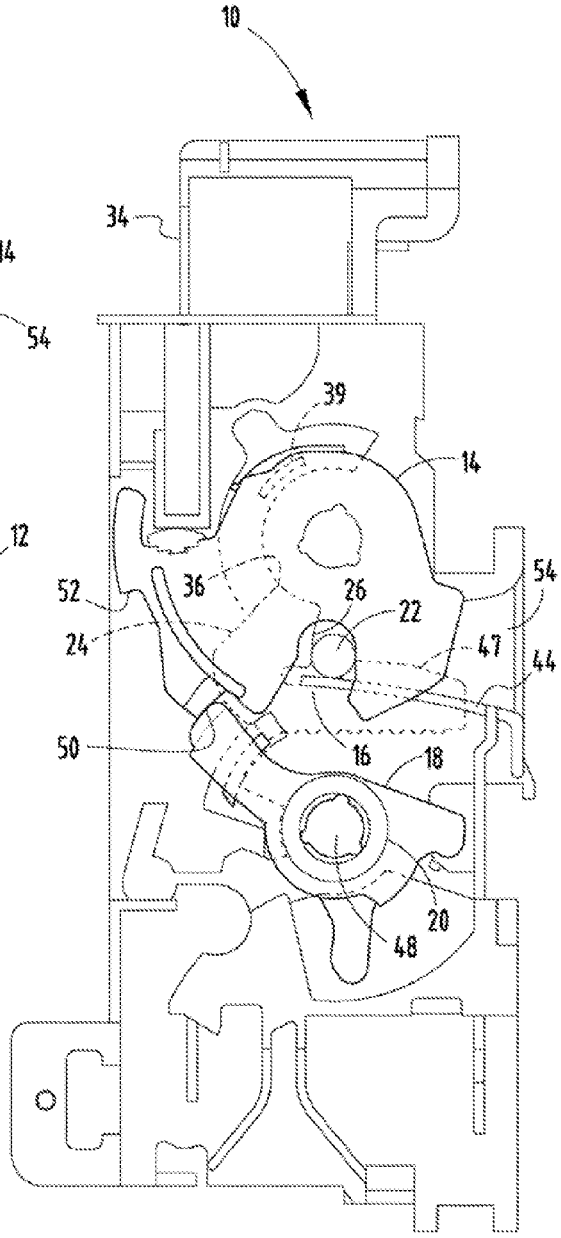
FIG. 22 is a side elevational view of the vehicle door latch mechanism in a closed position with the front plate removed.

Referring now to the embodiment illustrated in FIGS. 1 and 2, the reference numeral 10 generally designates a vehicle door latch mechanism having a frame plate 12. A catch 14 is rotatably connected with the frame plate 12 and includes a striker retaining slot 16. A pawl 18 is operably connected with the frame plate 12. A pawl isolation disk 20 is disposed between the pawl 18 and the frame plate 12. A striker 22 (FIG. 17) is adapted for engagement with the catch 14. A striker bumper 24 is adjacent the frame plate 12 and includes an abutment surface 26 and a striker damper surface 28.

Referring again to FIGS. 1 and 2, the vehicle door latch mechanism 10 is generally designed for use on a vehicle 30, having a vehicle door 32 with a door handle 31 and that is rotatable about a door hinge mechanism 33. The vehicle door latch mechanism 10 may be installed on the driver side door, passenger side door, or rear passenger doors. Additionally, the vehicle door latch mechanism 10 may be installed in the vehicle door opening on the B-pillar or may be disposed on an engagement side of the door, as represented in FIG. 1. The vehicle door latch mechanism 10 includes a housing 34 behind the frame plate 12 that helps protect the vehicle door latch mechanism 10 from damage, as well as dirt and debris. The housing 34 is secured to the vehicle door 32 by a plurality of mechanical fasteners. The catch 14 is disposed behind the housing 34 between the frame plate 12 and the housing 34 and is rotatably coupled with the housing 34. The housing 34 and frame plate 12 generally form the striker retaining slot 16 adapted to receive the striker 22. The striker 22 is designed to engage the catch 14, as will be disclosed in further detail below.

Figure 16:
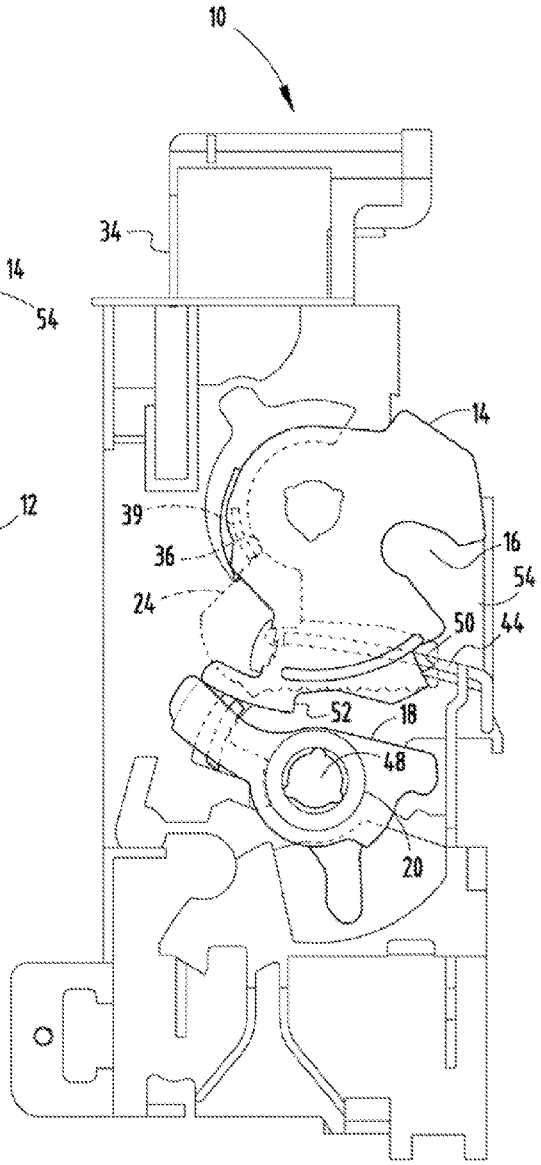
FIG. 16 is a side elevational view of the vehicle door latch mechanism in the open position with the frame plate removed.

Referring now to the embodiment illustrated in FIGS. 3-9, the striker bumper 24 includes a body portion with a striker damper surface 28 and an abutment surface 26 that is substantially orthogonal to the striker damper surface 28. A damper tab 36 is positioned above the abutment surface 26. The damper tab 36 includes a triangular construction with a peak 37 of the triangular construction disposed at a topmost portion of the striker bumper 24. The peak 37 is adapted to abut a catch bumper 39 (FIG. 16) of the catch 14 of the vehicle door latch mechanism 10 during opening to prevent the catch 14 from making an impact sound when a door handle 31 is opened. A base portion 38 of the striker bumper 24 includes a plurality of scalloped recesses 40 upon which the striker bumper 24 rests when in position in the vehicle door latch mechanism 10.

A securing slot 42 is disposed in the body portion of the striker bumper 24. The securing slot 42 receives a damper plate 44 (FIG. 16) that abuts the striker 22 during opening and closing of the vehicle door 32 as disclosed in further detail below. Adjacent to the damper tab 36 is a planar engagement area 46 that helps secure the striker bumper 24 in position in the vehicle door latch mechanism 10. The planar engagement area 46 is orthogonal to the abutment surface 26 and substantially coplanar with the striker damper surface 28 of the striker bumper 24. An engagement wall 47 is disposed substantially orthogonal to the abutment surface 28 and is designed to rest against the housing 34 of the vehicle door latch mechanism 10.

The striker bumper 24 is generally constructed of polynorbornene, which acts as a damper that does not respond to compression by storing a substantial amount of elastic energy. Accordingly, the striker bumper 24 receives applied forces developed during the closure of the vehicle door 32 and absorbs those forces without storing substantial potential energy. Consequently, little or no stored elastic energy is disposed in the striker bumper 24 when the vehicle door 32 is in the closed position, as will be discussed in more detail below.

Figure 10:
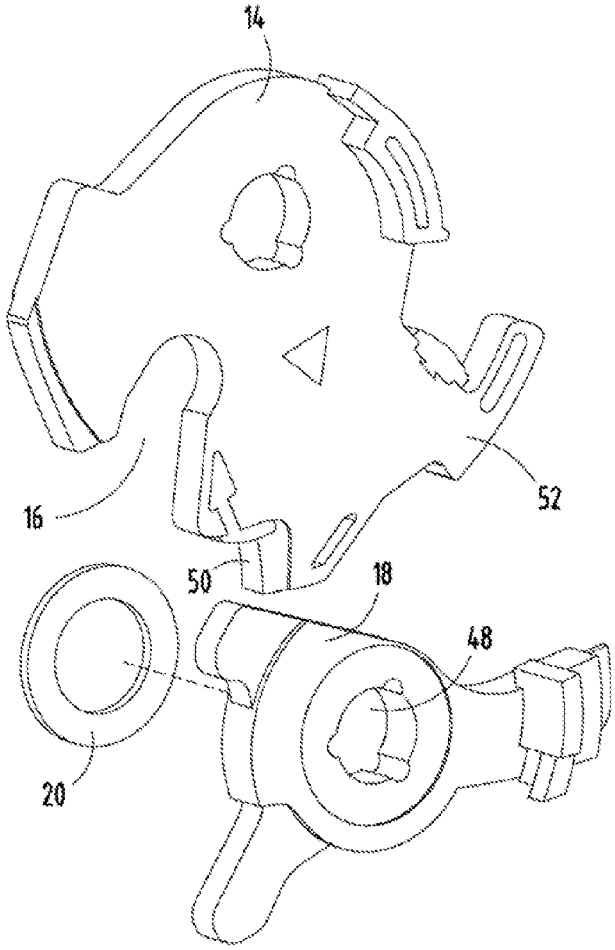
FIG. 10 is a top perspective exploded view of a catch, a pawl, and a pawl isolation disk of the vehicle door latch mechanism.
Figure 11:
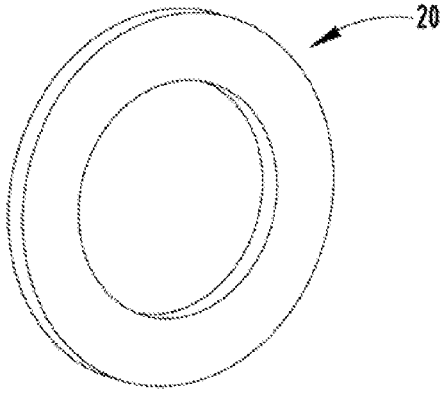
FIG. 11 is a top perspective view of the pawl isolation disk.
Figure 12:
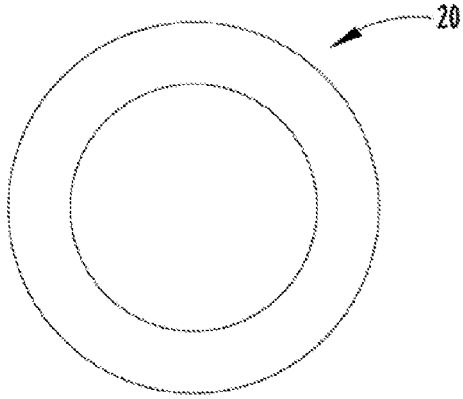
FIG. 12 is a side elevational view of the pawl isolation disk.
Figure 13:
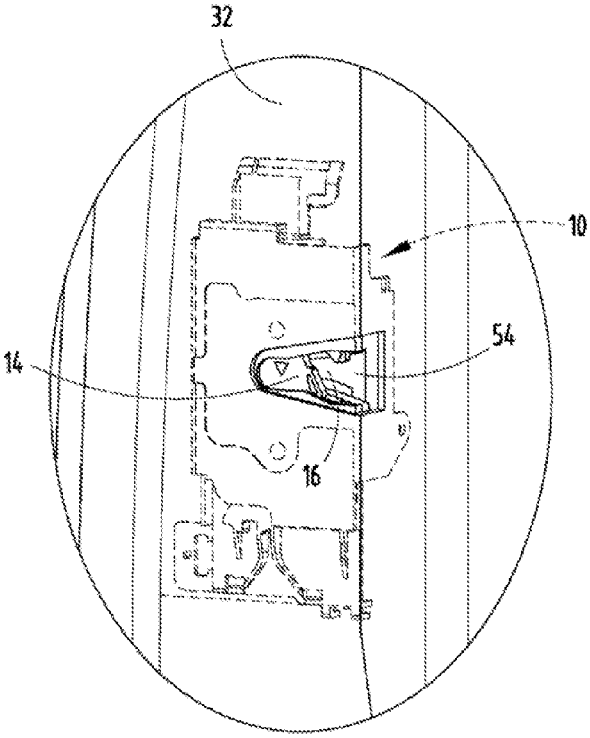
FIG. 13 is an enlarged top perspective view of the vehicle door of FIG. 1 illustrating the vehicle door latch mechanism in an open position.
Figure 14:
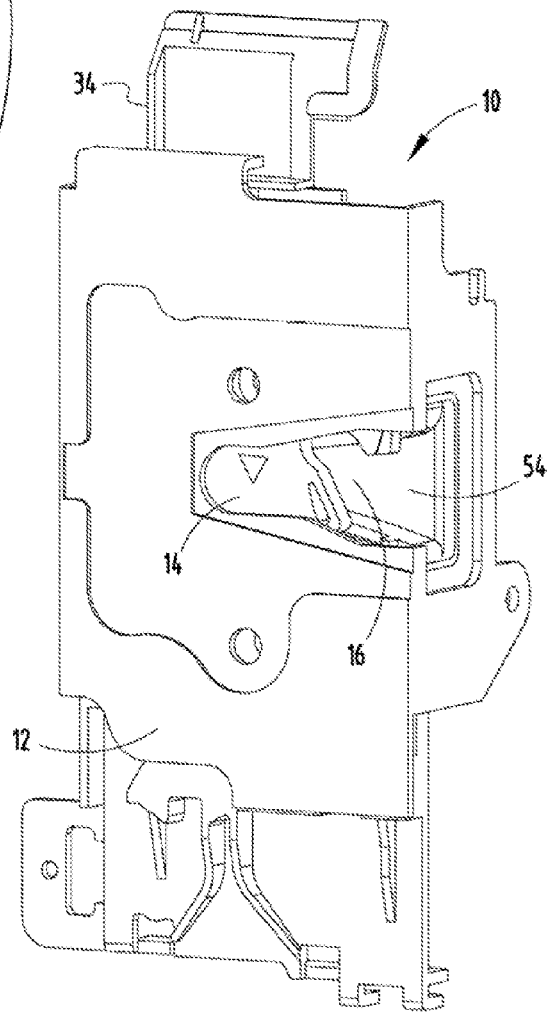
FIG. 14 is a top perspective view of the vehicle door latch mechanism in the open position.
Figure 15:
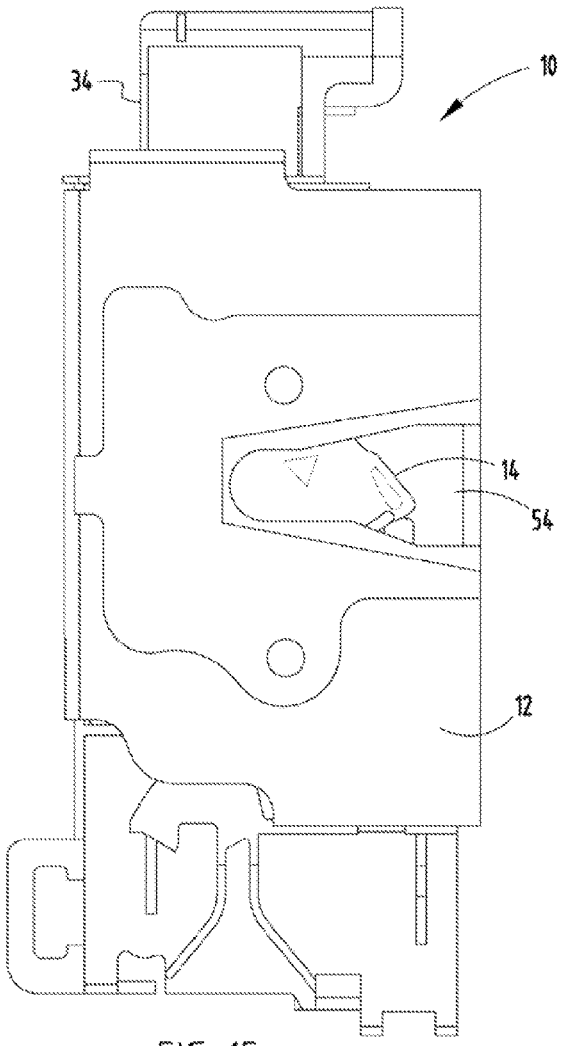
FIG. 15 is a side elevational view of the vehicle door latch mechanism in the open position.

Referring to FIGS. 10-12, the pawl 18 may be coated with a semi-rigid overmold material, which assists in sound dampening during operation of the vehicle door latch mechanism 10. The overmold coating material is semi-rigid. The pawl isolation disk 20 mounted between the pawl 18 and the frame plate 12 assists in dampening sound generated during operation of the vehicle door latch mechanism 10. Specifically, sound created due to engagement/disengagement of the pawl 18 and catch 14, movement of the pawl 18, and vibrations associated with the pawl 18 and the adjacent frame plate 12 are dampened by the pawl isolation disk 20. The pawl isolation disk 20 may optionally be operably coupled to an outer surface of the pawl 18 or frame plate 12 and reside between the pawl 18 and the housing 34, as mentioned above or can be sandwiched between the pawl 18 and the frame plate 12 without being coupled to either. Alternatively, the pawl isolation disk 20 may be integrally formed with the pawl 18 as a single manufactured component.

The pawl isolation disk 20 may be formed of any suitable sound-dampening material, including Santoprene. The hardness of the pawl isolation disk 20 is approximately 80 Shore A durometer, but may be lowered as the disk thickness is increased. The pawl isolation disk 20 may be formed of various geometric configurations, but typically will be shaped as a circular disk, as illustrated in FIGS. 11 and 12. Irrespective of the specific geometric configuration, the pawl isolation disk 20 includes an aperture and is mounted to the pawl 18, such that the pawl isolation disk 20 circumferentially surrounds a pawl aperture 48, which defines an axis about which the pawl 18 rotates. The pawl isolation disk 20 may be mounted to the pawl 18 by a suitable adhesive or mechanical fastener or can be molded onto the pawl 18 by a two shot molding process. The pawl isolation disk 20 thickness will range based on the application, however, a thickness of approximately 1/32" may be employed successfully. This thickness may increase or decrease and this variability will adjust the appropriate hardness of the pawl isolation disk 20.

Although the pawl isolation disk 20 may absorb energy during all phases of the opening and closing process of the vehicle door latch mechanism 10, the most critical energy absorption that leads to sound dampening occurs at a final stage of closure and at the initial stage of opening of the vehicle door latch mechanism 10. Specifically, during a closing process of the vehicle door 32, the critical sound dampening occurs upon engagement of the pawl 18 and the catch 14. During an opening process of the vehicle door 32, the critical sound dampening occurs upon disengagement of the pawl 18 and catch 14.

Referring to FIGS. 13-22, the vehicle door latch mechanism 10 is operable between a closed, semi-closed, and an open position. The catch 14 includes a first stop 50 and a second stop 52 that correspond with the closed and semi-closed positions, respectively. The vehicle door 32 is in the open position (FIGS. 13-16) when the engagement side of the vehicle door 32 is not proximate the B-pillar of the vehicle door 32 opening and passengers can enter or exit the vehicle door 32 opening. The vehicle door 32 is in the semi-closed position (FIGS. 17 and 18) when the vehicle door 32 is not completely closed and sealed against the door opening. Stated differently, the semi-closed position is when the vehicle door 32 is latched but slightly ajar. The vehicle door 32 is in the closed position (FIGS. 19-22) when the vehicle door 32 is fully latched and sealed against the vehicle door 32 opening, which includes full engagement between the pawl 18 and the catch 14.

Referring again to FIGS. 13-22, the striker retaining slot 16 of the catch 14 opens outwardly when the catch 14 is in the open position such that a receiving slot 54 in the frame plate 12 is aligned with the striker retaining slot 16. The catch 14 rotates about a pivot pin (not shown) between a fully-rotated position, semi-rotated position, and open position that corresponds with the closed, semi-closed, and open positions of the door, respectively. As will be understood by one having ordinary skill in the art, the pawl 18 is released by actuation of the vehicle door handle 31 by a user. When the pawl 18 is released, the catch 14, which is spring-biased to the open position, is free to rotate to the open position, thus releasing the striker 22 so that the vehicle door 32 can be opened. In the illustrated embodiment, the catch 14 is spring-biased to the open position by a clock spring (not shown) disposed behind the catch 14.

When the vehicle door 32 is in the open position (FIGS. 13-16), the catch 14 is in the open position such that the striker retaining slot 16 is available to receive and retain the striker 22. As mentioned above, when the striker retaining slot 16 is in the open position, the striker retaining slot 16 is generally adjacent to and parallel with the receiving slot 54. During closure, the vehicle door latch mechanism 10 swings with the vehicle door 32 about the door hinge mechanism 33 (FIG. 1) and engages the striker 22. More specifically, the receiving slot 54 receives the striker 22. As the striker 22 engages the receiving slot 54, the striker 22 also engages the striker retaining slot 16. At the same time, the striker 22 also makes tangential contact with the damper plate 44 juxtapositioned over the striker damper surface 28. The damper plate 44 serves to protect the striker damper surface 28 from excessive wear during extended use of the vehicle door latch mechanism 10. The damper plate 44 may be in abutting contact with the striker damper surface 28, or disposed slightly above the striker damper surface 28. In either instance, at least a portion of the damper plate 44 is received in the securing slot 42 of the striker bumper 24. The striker 22 is guided over the damper plate 44 into the striker retaining slot 16.

As the striker 22 engages the striker retaining slot 16, the catch 14 rotates downward under the force of the closing vehicle door 32 to secure the striker 22 in one of the fully-rotated or semi-rotated positions. When a predetermined minimum amount of closure force is not met, the vehicle door 32 either does not close or only latches, thus placing the vehicle door 32 in the semi-closed position. When the vehicle door latch mechanism 10 is in the semi-closed position, the catch 14 receives the striker 22 into the striker retaining slot 16, but does not rotate to the fully-rotated position.

When the predetermined minimum amount of force is applied to the vehicle door 32 during the act of closure, the catch 14 of the vehicle door latch mechanism 10 engages the striker 22. Upon contact with the striker 22, the catch 14 rotates past the semi-rotated position to the fully closed position. When the vehicle door latch mechanism 10 is in the fully closed position, the striker 22 engages the abutment surface 26 of the striker bumper 24. As the striker 22 engages the abutment surface 26, excess energy used in closing the vehicle door 32 is received and absorbed into the abutment surface 26 of the striker bumper 24 and dissipated. As a result, the NVH characteristics of the vehicle door 32 closing event are minimized. The vehicle door 32 is now in the fully closed position.

Referring again to FIGS. 13-16, to return the vehicle door 32 to the open position, a user actuates the handle 31 connected with the vehicle door latch mechanism 10, actuating the same. As the door handle 31 is actuated, the catch 14 rotates clockwise a small amount, thereby allowing the pawl 18 to rotate counterclockwise out of interference with the first stop 50 of the catch 14. During actuation of the door handle 31 and rotation of the catch 14 clockwise, the catch bumper 39 abuts the damper tab 36 (FIG. 16), thereby minimizing the noise output associated with actuation of the door handle 31 during the vehicle door 32 opening sequence. When the pawl 18 has rotated a predetermined distance counterclockwise, the catch 14 rotates counterclockwise and the pawl 18 clears the first stop 50 and the second stop 52 that correspond with the closed and semi-closed positions, respectively. The vehicle door 32 is then pulled open by a user, which results in the striker 22 being withdrawn from the striker retaining slot 16 and ultimately the receiving slot 54. As the striker 22 is withdrawn from the receiving slot 54 and the striker retaining slot 16, the catch 14 continues to rotate under spring-bias in a counterclockwise direction until the striker retaining slot 16 is once again aligned with the receiving slot 54 and ready for subsequent engagement of the striker 22 during another closure event.

Each of the pawl isolation disk 20 and the striker bumper 24 decrease the noise output levels associated with operation of the vehicle door latch mechanism 10. Specifically, as the striker 22 enters or exits the vehicle door latch mechanism 10, significant energy is transferred in the overall system and released in part as noise. The pawl isolation disk 20 and the striker bumper 24 independently reduce this noise output substantially. Typically, this noise level will be within 92-98 decibels in response to typical forces associated with a closing action, but testing has produced even lower decibel levels. The pawl isolation disk 20 and striker bumper 24 are formed of a material and geometry, such that their absorption of energy during opening or closing of the vehicle door 32 reduces the decibel level heard by an occupant of the vehicle 30.

To minimize NVH characteristics of the vehicle door 32 closing and opening sequences, dampers are installed into the vehicle door latch mechanism 10 to lower the decibel output associated with these events. The pawl isolation disk 20 and striker bumper 24 lessen noise output during the vehicle door 32 unlatching, opening, and closing events.

It is to be understood that variations and modifications can be made on the aforementioned structure without departing from the concepts of the present invention, and further it is to be understood that such concepts are intended to be covered by the following claims unless these claims by their language expressly state otherwise.

What is claimed is:

1. A vehicle door latch mechanism comprising:

a housing;

a frame plate adapted to be connected to the housing;

a catch rotatably connected with the housing and having a striker retaining slot;

a pawl operably connected with the housing;

a pawl isolation disk disposed between the pawl and the frame plate;

a striker adapted for engagement with the catch; and a striker bumper configured to contact the striker when the striker is moved toward engagement with the catch, the striker bumper is adjacent the housing and having a striker damper surface and an abutment surface that is substantially orthogonal to the damper surface; the striker bumper further includes an engagement wall extending substantially orthogonal from a side of the damper surface and interconnecting the damper surface with the abutment surface, wherein the engagement wall is configured to abut the housing.

2. The vehicle door latch mechanism of claim 1, wherein the striker bumper includes a securing slot in the abutment surface that is in alignment with the damper surface, wherein the securing slot is configured to receive an e portion of a damper plate that extends over the damper surface.

3. The vehicle door latch mechanism of claim 1, wherein the catch rotates between an open position, where the retaining slot is aligned with a receiving slot in the frame plate, and a closed position, where the retaining slot is substantially orthogonal to the receiving slot to retain the striker therein.

4. The vehicle door latch mechanism of claim 3, wherein the pawl engages the catch in the closed position, and wherein the striker is retained in abutting contact with the abutment surface when the catch is in the close position.

5. The vehicle door latch mechanism of claim 1, further comprising:

a damper tab positioned proximate the abutment surface, wherein the damper tab further includes a triangular construction adapted to abut a portion of the catch.

6. The vehicle door latch mechanism of claim 1, wherein the striker bumper is comprised at least partially of a polynorbornene material to absorb and dissipate energy received from the striker contacting the striker bumper.

7. The vehicle door latch mechanism of claim 1, wherein the pawl isolation disk is comprised at least partially of a santoprene material to dampen sound from the pawl engaging and disengaging the catch.

8. A vehicle door latch mechanism comprising:

a frame plate covering a housing;

a catch rotatably coupled to the housing;

a retaining slot in the catch configured to align with a receiving slot in the frame plate and to engage a striker;

a striker bumper comprising:

an abutment surface to contact the striker:

a damper surface orthogonal to the abutment surface; and a wall abutting the housing and orthogonally connecting the damper and abutment surfaces.

9. The vehicle door latch mechanism of claim 8, wherein the striker bumper further comprises a damper tab with a triangular construction, and wherein the peak of the triangular construction is adapted to abut the catch of a vehicle door latch mechanism.

10. The vehicle door latch mechanism of claim 8, wherein the striker bumper further comprises a base portion including a plurality of scalloped recesses.

11. The vehicle door latch mechanism of claim 8, wherein the striker bumper further comprises a securing slot disposed in the abutment surface and in alignment with the damper surface, wherein the securing slot is configured to receive a damper plate juxtapositioned over the damper surface.

12. The vehicle door latch mechanism of claim 8, wherein the damper surface is configured to tangentially contact the striker when the striker is moved toward or away from the abutment surface.

13. The vehicle door latch mechanism of claim 8, wherein the catch rotates between a open position, where the retaining slot is aligned with the receiving slot, and a closed position, where the retaining slot is substantially orthogonal to the receiving slot to retain the striker in abutting contact with the abutment surface of the striker bumper.

14. A method of making a vehicle door latch comprising:

forming a housing;

connecting a frame plate to the housing;

rotatably connecting a pawl and a catch having a striker retaining slot between the housing and the frame plate;

positioning a pawl isolation disk between the pawl and the frame plate; and positioning a striker bumper adjacent the housing having a damper surface and an abutment orthogonal thereto to contact a striker engaging the catch.

15. The method of making a vehicle door latch of claim 14, further comprising:

forming an engagement wall extends substantially orthogonal from an edge of the damper surface to connect the damper surface with the abutment surface, and wherein the engagement wall abuts the housing.

16. The method of making a vehicle door latch of claim 14, wherein the damper surface is configured to tangentially contact the striker when the striker is moved toward or away from the engagement with the catch.

17. The method of making a vehicle door latch of claim 14, further comprising:

constructing a damper tab positioned proximate the abutment surface and having a triangular construction adapted to abut the catch.

18. The method of making a vehicle door latch of claim 17, wherein the step of constructing a damper tab further comprises:

forming a receiving slot in the frame plate that is configured to align with the striker retaining slot in the catch when the catch is in an open position and not engaging the striker.

19. The method of making a vehicle door latch of claim 14, further comprising:

forming the striker bumper at least partially from a polynorbornene material.

20. The method of making a vehicle door latch of claim 14, further comprising:

forming the pawl isolation disk at least partially from a santoprene material.

* * * * *